US005156002A

United States Patent [19]

Mowill

[11] Patent Number: 5,156,002

[45] Date of Patent: Oct. 20, 1992

[54] LOW EMISSIONS GAS TURBINE COMBUSTOR

[75] Inventor: Rolf J. Mowill, Rugdeveien 7, 0386 Oslo 3, Norway

[73] Assignee: Rolf J. Mowill, Oslo, Norway

[21] Appl. No.: 658,858

[22] Filed: Feb. 21, 1991

Related U.S. Application Data

[63] Continuation-in-part of Ser. No. 488,136, Mar. 5, 1990, Pat. No. 5,070,700.

[51] Int. Cl.[5] ..... F23R 3/32; F23R 3/34

[52] U.S. Cl. ..... 60/738; 60/746; 431/174

[58] Field of Search ..... 60/39.36, 39.826, 733, 60/737, 738, 746, 748; 431/174, 187, 353

[56] References Cited

U.S. PATENT DOCUMENTS

| | | | |
|---|---|---|---|
| 1,705,383 | 3/1929 | Weiss | 431/174 |
| 2,183,836 | 12/1939 | Gordon, Jr. | 431/187 |
| 3,626,444 | 12/1971 | Carvel | 60/738 |
| 3,768,962 | 10/1973 | Baranowski, Jr. | 431/353 |
| 4,260,367 | 4/1981 | Markowski et al. | 431/353 |
| 4,305,255 | 12/1981 | Davies et al. | 60/746 |
| 4,389,848 | 6/1983 | Markowski et al. | 60/738 |
| 4,457,704 | 7/1984 | Sommers et al. | 431/353 |
| 4,610,135 | 9/1986 | Alexander | 60/738 |
| 4,974,415 | 12/1990 | Stekleton et al. | 60/733 |

*Primary Examiner*—Richard A. Bertsch
*Assistant Examiner*—Timothy S. Thorpe
*Attorney, Agent, or Firm*—Finnegan, Henderson, Farabow, Garrett & Dunner

[57] ABSTRACT

A combustor for a gas turbine engine includes divergent mixing cones disposed substantially within the combustion chamber proper to provide a flow restriction which separates the combustion chamber into primary and secondary combustion zones. Placement of the mixing cones within the chamber enhances vaporization of the fuel and permits combustion to take place in the primary zone at flame temperatures below the stoichiometric temperature thereby reducing formation of nitrous oxides. The mixing cones have external cooling shrouds to prevent autoignition, and the mixing cones for the primary zone provide tangential swirl of the vaporized fuel/air charge in a direction opposite that of the secondary mixing cones. The mixing cones together with an associate fuel nozzle sub-assembly form an integrated unit separable from the combustor for calibration and setting of the fuel/air ratio.

19 Claims, 13 Drawing Sheets

LOW EMISSIONS GAS TURBINE COMBUSTOR

This is a continuation-in-part of application Ser. No. 07/488,136, filed Mar. 5, 1990, now U.S. Pat. No. 5,070,700.

BACKGROUND OF THE INVENTION

1. Field of the Invention

The present invention relates to gas turbine engines and, more specifically, to combustors for gas turbine engines.

2. Description of the Related Art

Nitrous oxides, hereinafter $NO_x$, are formed during combustion of fuel with air. Recent investigations and experimentation lead to the conclusion that all $NO_x$ formation is "prompt $NO_x$", i.e., $NO_x$ formed during a non-equilibrium combustion process occurring a very short period of time, a few milliseconds, after initiation of the combustion process. It has only recently been postulated that such a non-equilibrium condition creates a severe temperature spike which rapidly decays to the equilibrium temperature, and that substantially all $NO_x$ is formed during these high peak temperatures. This observation has lead to the conclusion that formation of $NO_x$ is independent of residence time within a combustion chamber but is exponentially related to the temperature at which combustion occurs. Such a conclusion is in contradiction to conventional thinking which relates $NO_x$ formation to residence time.

FIG. 1 shows the experimental relationship between $NO_x$ formation and flame temperature. In this figure, the temperature is the equilibrium flame temperature and the amount of $NO_x$ is the sum of all $NO_x$ formed as the temperature drops from its initial high value to the equilibrium value. The amount of $NO_x$ is shown in FIG. 1 as a log value. Hence, while the curve of FIG. 1 is substantially straight, it in fact reflects the exponential relationship to flame temperature.

Because combustion systems using air as the oxygen source always contain mostly nitrogen, and because the relaxation time from the non-equilibrium to equilibrium condition depends solely on the molecules involved in the combustion process, the curve of FIG. 1 is valid for any air-breathing combustion system. Furthermore, the $NO_x$ formation rate at the equilibrium temperature conditions has been shown to be so low that it does not measurably affect the amount of $NO_x$ formed in normal combustion systems where the gas is at the equilibrium temperature for times of a few seconds or less.

Thus, it is an object of the present invention to provide a premixed, convection cooled, low $NO_x$ emission combustor having structural features which take advantage of the conclusion that substantially all $NO_x$ formation is "prompt $NO_x$" related only to the temperature at which combustion occurs and not related to the residence time within the combustion chamber.

It is a further object of the present invention to provide a combustor for a gas turbine engine having improved abilities to vaporize and mix the fuel and air prior to being burned in the combustion chamber.

It is still a further object of the present invention to provide a combustor configuration for a gas turbine engine having a convection cooling air flow passage sur unding the hot wall of the combustor which is substantially free of obstructions to thereby enhance the effectiveness of the cooling air flow through the passages. Such a construction also simplifies the mechanical design of the combustor, reduces manufacturing costs, and simplifies inspection procedures drastically improves durability due to such lower gradients in the wall.

It is still a further object of the present invention to provide a combustor configuration which requires fewer fuel injection nozzles than present designs.

It is also an object of the present invention to provide a combustor configuration having a combustion chamber which is separated into primary and secondary combustion zones wherein burning of fuel and air in the primary combustion zone occurs at a reduced flame temperature thereby reducing formation of $NO_x$.

It is still a further object of the present invention to provide a combustor configuration adapted for convection cooling of the combustor wall wherein all the cooling air is used in the combustion process for either combustion with the fuel or for dilution of the products of combustion to reduce the temperature of the gas entering the turbine.

It is still a further object of the present invention to provide a combustor configuration which reduces the amounts of unburned hydrocarbons and carbon monoxide.

SUMMARY OF THE INVENTION

To achieve the foregoing objects, and in accordance with the purposes of the invention as embodied and broadly described herein, a premixed, convection cooled, low emission combustor is provided comprising a combustion chamber for defining a space within which fuel and air are combusted. The combustor further includes means for mixing the fuel and air and for depositing a fuel and air mixture into the combustion chamber. The mixing means, in contrast to known combustor configurations, is largely disposed within the combustion chamber proper.

In a preferred embodiment, the combustor also includes means for defining primary and secondary combustion zones within a combustion chamber. The defining means may conveniently be comprised of the mixing means which, since disposed within a combustion chamber proper, create a flow restriction which separates the primary combustion zone from the secondary combustion zone. As used herein, separation of the combustion zones is not intended to mean complete isolation of one zone from the other. Rather, separation as used herein means creating a sufficient pressure differential between the zones so that combustion or oxidation of fuel and air in each zone occurs substantially independently with the products of combustion from the primary zone flowing through the secondary zone to exit from the combustion.

A substantially homogenous fuel and air mixture is initially deposited in the primary combustion zone by the mixing means without burning occuring in the mixing means. The fuel-to-air weight ratio of the mixture deposited in the primary combustion zone is closely controlled and is preferably kept below about 50% of the chemically correct stoichiometric ratio of the weight of the fuel to the weight of the air during the entire operating or power range of the engine. Since the flame temperature is directly related to the fuel to air weight ratio, the flame temperature of the fuel and air mixture burned in the primary combustion zone is reduced by keeping the ratio below the stoichiometric ratio. Since the present invention is based on the premise that substantially all $NO_x$ formation is "prompt $NO_x$" and is affected only by the flame temperature during the initial non-equilibrium burn and not by the residence time, the combustor of the present invention limits the formation of $NO_x$ by reducing the flame temperature in the combustion zone.

It is further preferable that the mixing means comprises primary and secondary diverging cones. Each primary and secondary cone is defined by a wall which diverges from an inlet end towards an outlet end. The inlet end is in flow communication with a source of fuel and with the engine air. The divergence angle and the length of the cones defining the mixing means are selected to ensure a complete mixing of the fuel and air prior to being deposited in the combustion chamber and to further ensure that combustion within the cones does not occur. In the case of a liquid fuel, vaporization of the fuel is enhanced as a result of the wall defining the cone being disposed within the combustion chamber and therefore being heated by the flame within the combustion chamber.

When the engine is at idle, fuel is injected into the combustion chamber only through the primary cones, and part of the dilution air is added through the secondary cones. This condition exists for a range of engine power which is determined by the selection of the maximum fuel to air weight ratio for the primary combustion zone. Where the engine is intended to operate over a wider range of power, additional fuel is deposited into a secondary combustion zone through secondary mixing cones. The fuel and air deposited in the secondary combustion zone is oxidized by the products of combustion emerging from the primary combustion zone and the en of this secondary fuel stream is released, even though the fuel/air ratio might be below the limit of flammability.

It is further preferable that the primary and secondary mixing cones be adapted and disposed within the combustion chamber so as to direct the fuel and air mixture emerging from each in opposite circumferential directions within the respective combustion zone so as to create a counter-swirl condition to enhance mixing when the hot combustion products from the primary zone pass into the secondary zone.

Because the primary and secondary mixing cones are disposed within the combustion chamber proper, and because the fuel and air mixture emerging from those cones is at a lower temperature than the products of combustion, those cones are cooled by the fuel and air mixture. In this configuration, the combustor according to the present invention does not require any special cooling air flow paths to cool the means for defining the primary and secondary combustion zones since the flow restriction created by the cones is already air-cooled by the engine air entering the cones.

It is also preferred that the combustor include means cooperating with the mixing means, for suppressing auto-ignition of the fuel/air mixture in the primary and secondary mixing cones. The suppression means can specifically include respective shrouds surrounding and spaced from the primary and secondary mixing cones for channeling cooling air flow therebetween and means for metering the channeled cooling air flow. The shrouds can preferably be double-walled members providing recirculation of the cooling air to the vicinity of the respective mixing cone inlet, and means such as apertures be provided to mix the cooling air with the fuel and air in the mixing cone itself.

It is yet further preferred that means such as a manifold are provided for interconnecting and controllably distributing air to at least several of the primary and secondary mixing cones. The manifold also can be flow interconnected to receive convection cooling air from the combustion chamber.

It is still further preferred that the combustor further include respective fuel nozzle mean associated with each of the primary and secondary mixing cones, and that the mixing cones and associated fuel nozzle means are configured as an integrated unit assembly retractable from the combustion chamber. The fuel/air ratio of each unit assembly can be then advantageously calibrated and set prior to installing the mixing cone in the combustion chamber. The unit assembly can include adjustable means for selectively fixing the distance between the mixing cone throat and the nozzle each associated fuel nozzle means.

The present invention also covers a method of operating a combustor of the type having a combustion chamber separated into primary and secondary combustion zones by mixing cones disposed within the combustion chamber proper. Preferably, the method includes the steps of depositing a primary fuel and air mixture into the primary combustion zone through the mixing cones while maintaining the fuel to air weight ratio below the chemically correct stoichiometric ratio for the fuel. The primary fuel and air mixture is then burned in the primary zone at a temperature to thereby reduce $NO_x$ formation.

Where the engine power requirements, i.e. range, exceeds the energy released in the primary fuel and air mixture, the method of the present invention includes the further step of depositing additional fuel into the secondary combustion zone which will be oxidized by the hot combustion products emerging from the primary zone.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiments given below, serve to explain the principles of the invention. In the drawings.

DESCRIPTION OF THE PREFERRED EMBODIMENT AND METHOD

Figure 1:
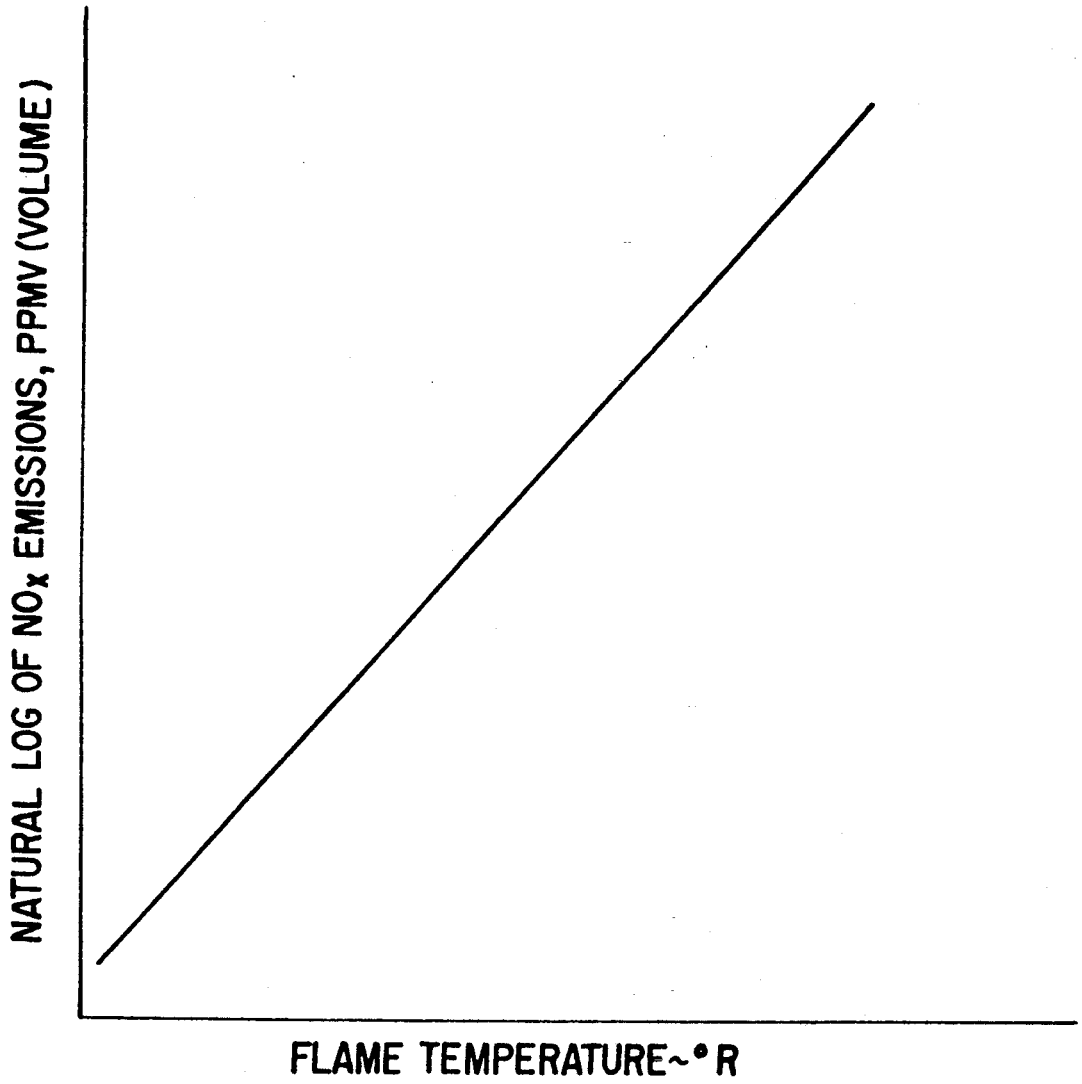
FIG. 1 is a graph illustrating the predicted relationship of flame temperature to the formation of $NO_x$ in a combustion process.

Reference will now be made in detail to the presently preferred embodiments and method of the invention as illustrated in the accompanying drawings, in which like reference characters designate like or corresponding parts throughout the several drawings.

Figure 2:
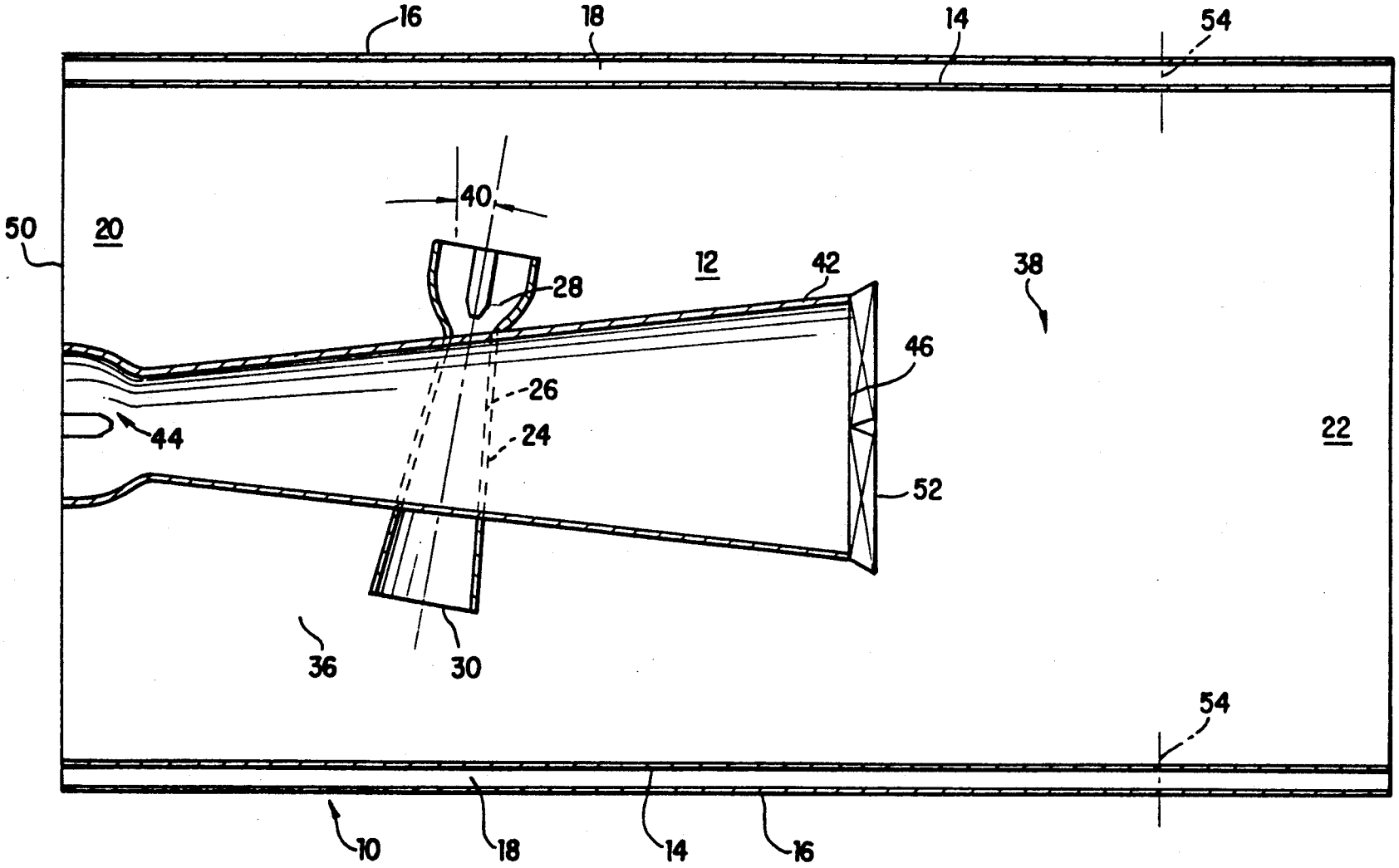
FIG. 2 is a cross-sectional principle view of a can-type combustor incorporating the teachings of the present invention.

FIG. 2 is a principle cross-sectional view of a can-type combustor generally referred to as 10. In accordance with the present invention, can-type combustor 10 includes a combustion chamber 12 having a hot combustor wall 14 which defines the chamber within which fuel and air are combusted. Combustion chamber 12 includes an upstream end 20 and a downstream end 22. Hot combustor wall 14 is surrounded by a cold combustor wall 16 to define a substantially annular cooling air flow passage 18. Engine air, i.e. air flowing through the turbine engine, enters cooling air flow passage 18 and flows along hot combustor wall 14 to thereby provide convection cooling.

The combustor of the present invention is particularly well suited to a convection cooling of the hot combustor wall as opposed to film cooling. Although either type of cooling arrangement may be used, within the broades of the invention air not taking part in the combustion should be limited as much as possible to avoid false "air". Moreover, since the present invention is based on the premise that substantially all $NO_x$ formation is "prompt $NO_x$" and is independent of residence time, the convection cooling arrangement permits all the engine air to be used in the combustion and dilution stages as will be described in more detail below. This, in turn, allows the engine designer to design for a longer residence time in the combustor thereby making possible the reduction of the amount of unburned hydrocarbons without increasing $NO_x$ formation as would be the consequence of conventional wisdom. Film cooling requires that some engine air be dedicated strictly to cooling the combustor wall by placing a thin film of cold air on the interior surface of the combustor wall. This thin film of cold air creates temperature gradients in the combustor wall which promote cracking and ultimate failure. Also, in a film cooling application the cold air entering the combustion chamber effects the fuel-to-air weight ratio and in certain instances quenches combustion in discrete areas of the combustion chamber thereby diminishing efficiency of the combustion process and increasing the amounts of unburned hydrocarbons. The present invention, by being particularly suited to a convection cooling arrangements, eliminates these drawbacks of film cooling.

In accordance with the present invention, the combustor further includes means, substantially disposed within the combustion chamber, for mixing fuel and air and for depositing a fuel and air mixture into the combustion chamber. As embodied herein, the mixing means comprises at least one primary diverging mixing cone 24 disposed within the combustion chamber proper. Any number of diverging cones 24 may be used to fit within the design constraints of a particular engine application. Each cone 24 is defined by a wall 26 which is substantially frusto-conical in shape and which diverges from an inlet end 28 to an outlet end 30.

Figure 3:
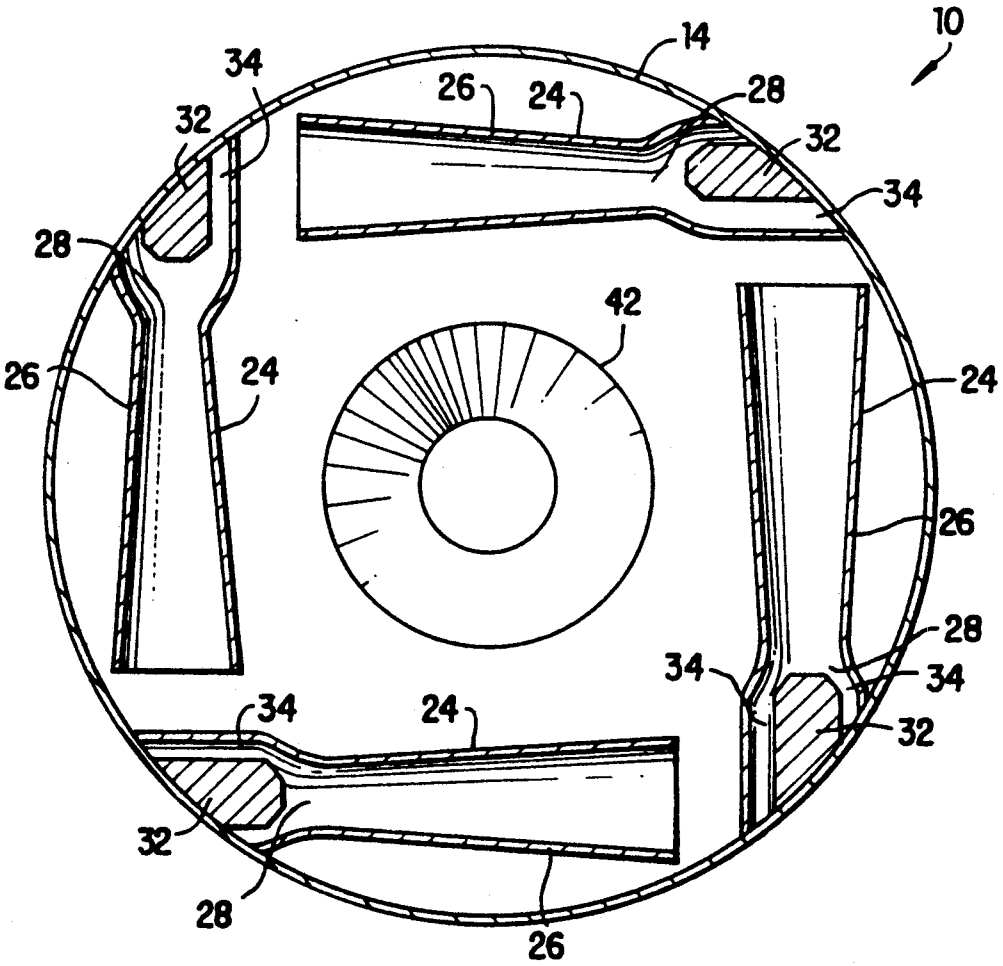
FIG. 3 is an end view of the can-type combustor of FIG. 2.

FIG. 3 is an end view of can-type combustor 10 illustrated in FIG. 2 and shows the primary diverging cones 24 to comprise four cones 24 which extend into combustion chamber 12 from hot combustor wall 14 at an angle approaching a tangent line from wall 14 at about the position of the injectors 32. Inlet end 28 of cone 24 is in flow communication with the source of fuel (not shown) which is injected into cone 24 through fuel injectors 32. Similarly, the inlet end 28 of each cone 24 communicates with the high pressure engine air exiting the compressor section (not shown) via a conduit 34 formed around fuel injector 32.

As fuel and air are injected into cones 24 via injectors 32 and conduit 34, they become homogeneously mixed within the cone prior to being deposited within the combustion chamber 12. The change in velocity of the air as it expands in cone 24 tends to shear the surface of the fuel droplets thereby enhancing vaporization and mixing. Also, cones 24 are sized such that the velocity of the air as it expands in the cone is kept greater than the flame speed in the combustion chamber so that the flame does not enter the cone causing premature combustion.

A particular advantage of the present invention over prior art combustors is the placement of the mixing means comprised of cones 24 substantially within the combustion chamber proper. In this manner, the cone walls 26 are heated by the flame temperature within combustion chamber 12 to enhance vaporization of liquid fuel, as well as saving external space.

The divergence angle of the cone wall 26 relative to the central axis of the cone is preferably selected to be the highest angle possible while still avoiding separation of the flow from the wall. Typically, aerodynamic constraints limit the divergence angle of cone wall 26 to a 6° half angle thus making a 12° total included angle. Smaller angles may be used but will likely require an increased length of the cone, particularly for liquid fuel.

Furthermore, in the preferred embodiment of the present invention, fuel injectors 32 are preferably mounted just upstream of the small diameter inlet ends of diverging cones 24. Fuel injector 32 may be made movable relative to inlet end 28 of cone 24 so as to calibrate the air flow entering the cone. In this manner, it is possible to balance the air flow through each cone 24 such that the same flow rate of air is always entering each cone. Thus, the fuel to air weight ratio in cones 24 is dependent only upon the fuel pressure, and hence fuel flow, at injectors 32.

To provide low $NO_x$ emission from the combustor, the present invention includes means for defining primary and secondary combustion zones within combustion chamber 12. As embodied herein, the defining means is comprised of the primary cones 24 disposed circumferentially around hot combustor wall 14 and when applicable, the secondary cone 42 to create a flow restriction by narrowing the effective cross-sectional area of the combustion chamber at the position where the cones are placed. In this manner, the combustion chamber is separated into axially aligned primary and secondary combustion zones 36 and 38, respectively.

In the combustor of the present invention, the primary fuel and air mixture deposited in combustion chamber 12 through primary cones 24 is directed toward primary combustion zone 36 by tilting cones 24 toward upstream end 20 of combustion chamber 12. The angle of tilt 40 of cones 24 may be between about 5° and 15°, and is preferably set at about 10°. However, the specific angle of tilt is not limitive of the scope of the present invention. Furthermore, the fuel-to-air weight ratio of the mixture emerging from primary cones 24 is preferably limited to less than about 50% of the chemically correct stoichiometric ratio while still being above the lowest fuel-to-air weight ratio which will support combustion. Of course, the fuel to air ratio in primary cones 24 will vary between the upper and lower limits as the engine is throttled and the fuel flow is adjusted accordingly by valve arrangements well known in the art.

By limiting the fuel-to-air weight ratio in primary cones 24 to below 50% of the stoichiometric value, the flame temperature in primary combustion zone 36 is reduced thereby reducing the amount of $NO_x$ formed during combustion.

Thus, by tilting diverging cones 24 toward upstream end 20 of combustion chamber 12, the primary fuel and air mixture emerging from cones 24 is directed toward primary combustion zone 36 where it may be ignited by conventional means to start the combustion. Furthermore, by disposing cones 24 circumferentially about hot combustor wall 14 at an angle approaching a tangent as illustrated in FIG. 2, the primary fuel and air mixture is directed into a swirling pattern in primary combustion zone 36. In that regard, a specific advantage of the configuration of the combustor of the present invention is that all of the fuel vaporization and mixing takes place within primary cones 24 and no space need be provided in the combustion zone for these two functions. Typically, a residence time of 3 to 10 milliseconds is adequate for the fuel and air mixture to be completely combusted within primary combustion zone 36.

Since the fuel-to-air weight ratio in primary combustion zone 36 is maintained well below the stoichiometric value, the flame temperature in primary combustion zone 36 is reduced. Because formation of $NO_x$ is assumed to be dependent on the flame temperature and not on the residence time in the combustor, the fuel and air mixture is burned in the primary combustion zone 36 with significantly reduced $NO_x$ formation. Furthermore, in contrast to conventional thinking, the residence time of the products of combustion in the combustion chamber may be increased to reduce the amounts of unburned hydrocarbons and CO without penalty of increased $NO_x$ emissions. Typically, such residence time may be increased by lengthening the combustion chamber or moving dilution holes further downstream.

In gas turbine engines that operate over a wide range of power, it is necessary that the mixing means include at least one secondary cone 42, having an upstream inlet end 44 and a downstream outlet end 46, for depositing additional fuel into the secondary combustion zone 38 of combustion chamber 12. A fuel injector 32 is disposed proximate inlet end 44 and engine air is introduced into secondary cone 42 through appropriate conduit paths. In the preferred embodiment of the can-type combustor of the present invention, secondary cone 42 extends into combustor 10 from an end wall 50 such that downstream end 46 is centrally disposed within combustion chamber 12 to deposit a secondary fuel and air mixture into secondary combustion zone 38. With such a configuration, secondary cone 42 acts in cooperation with primary cones 24 to provide a flow restriction within combustion chamber 12 to separate the combustion chamber into the upstream primary combustion zone 36 and the downstream secondary combustion zone 38.

In combustors which require the secondary cone and secondary fuel and air mixture, engine air in the preferred embodiment is always introduced into the combustion chamber through the secondary cone for dilution purposes even when additional fuel is not required at the low end of the power range. When engine power is increased by advancing the throttle, fuel flow through injectors 32 of primary cones 24 is initially increased while remaining within the predetermined fuel to air weight ratio selected for the primary combustion zone. This is shown graphically in FIG. 7 which plots the fuel to air ratio in the primary and secondary fuel and air streams as a function of engine power in a typical engine application.

Figure 7:
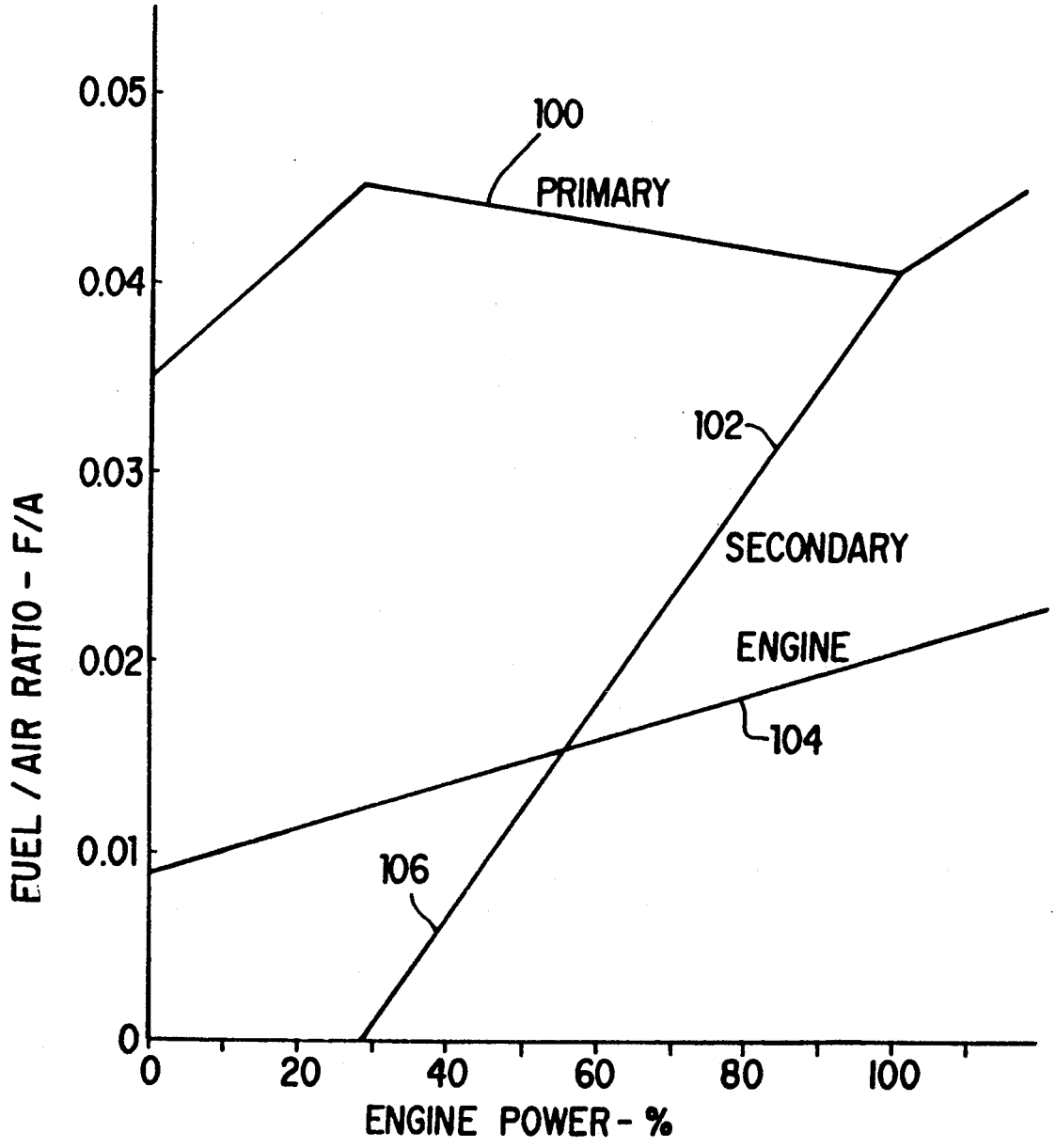
FIG. 7 is a graph illustrating how the fuel to air weight ratio in the primary and secondary fuel and air mixtures typically varies over the operating range of the engine.

Graph line 100 in FIG. 7 is the plot of the fuel to air weight ratio in the primary stream over the engine power range, and graph line 102 is the fuel to air ratio in the secondary stream. The overall engine fuel to air ratio is shown by line 104. As illustrated, when reaching a predetermined operating point 106, fuel is injected into and mixed with the air in secondary cone 42. As engine power is increased, the fuel to air ratio in the secondary stream continues to increase while the ratio of the primary stream tails off slightly. The graph of FIG. 7 is presented by way of example only. The particular trends shown are not limitive of the scope of the present invention since they may change for particular applications.

The additional fuel and air is initially supplied to cone 42 preferably at a weight ratio of fuel to air too low to support combustion. However, when this secondary mixture from cone 42 mixes with the hot products of combustion coming from primary combustion zone 36, the fuel in the secondary mixture is oxidized completely within second combustion zone 38.

Furthermore, to enhance mixing of the fuel and air emerging from cone 42 with the hot products of combustion coming from primary combustion zone 36, the preferred embodiment of the present invention incorporates a swirler 52 attached at the downstream end 46 of cone 42. Any known configuration of swirler may be utilized. For instance, a swirler comprised of a plurality of vanes equally spaced around the circumference of the downstream end of cone 42 and tilted at an angle to impart a swirling motion to the fuel and air mixture emerging from the cone may be used.

Also, the swirl direction important to the secondary mixture emerging from cone 42 is preferably selected to be counter to the direction of swirl of the combustion occurring in primary combustion zone 36. Such counter-swirl of the fuel and air mixtures in the primary and secondary combustion zones, and the ensuing counter-swirl of the combustion products since ignition of the fuel in fact occurs a very short distance from the outlet ends of the cones, enhances mixing in the secondary combustion zone.

Furthermore, because primary cones 24 and secondary cones 42 are disposed within combustion chamber 12, the configuration of the present invention has the advantages of simplifying the mechanical design of the combustor, reducing manufacturing cost and external dimensions, and making assembly and inspection procedures more efficient. Also, because the mixing cones of the present invention do not extend through the combustor wall, cooling air flow passage 18 is substantially free of obstructions thereby making the combustor wall particularly well suited to a convection cooling as opposed to film cooling. Thus, the disadvantages of film cooling, i.e. the need to use engine air strictly for cooling purposes, the temperature gradients in the combustor wall created by film cooling, and the lower efficiency of combustion, are eliminated.

With continued reference to FIG. 2, dilution holes 54 may be configured in hot combustor wall 14 downstream of second combustion zone 38. These dilution holes 54 function to introduce the remaining air which has not passed through the mixing means into the combustion chamber to thereby drop the outlet temperature of the products of combustion emerging from combustion chamber 12 to a level suitable for a turbine or other end device (not shown). Thus, combustor 12 utilizes all the engine air in either the combustion or dilution processes.

Figure 4:
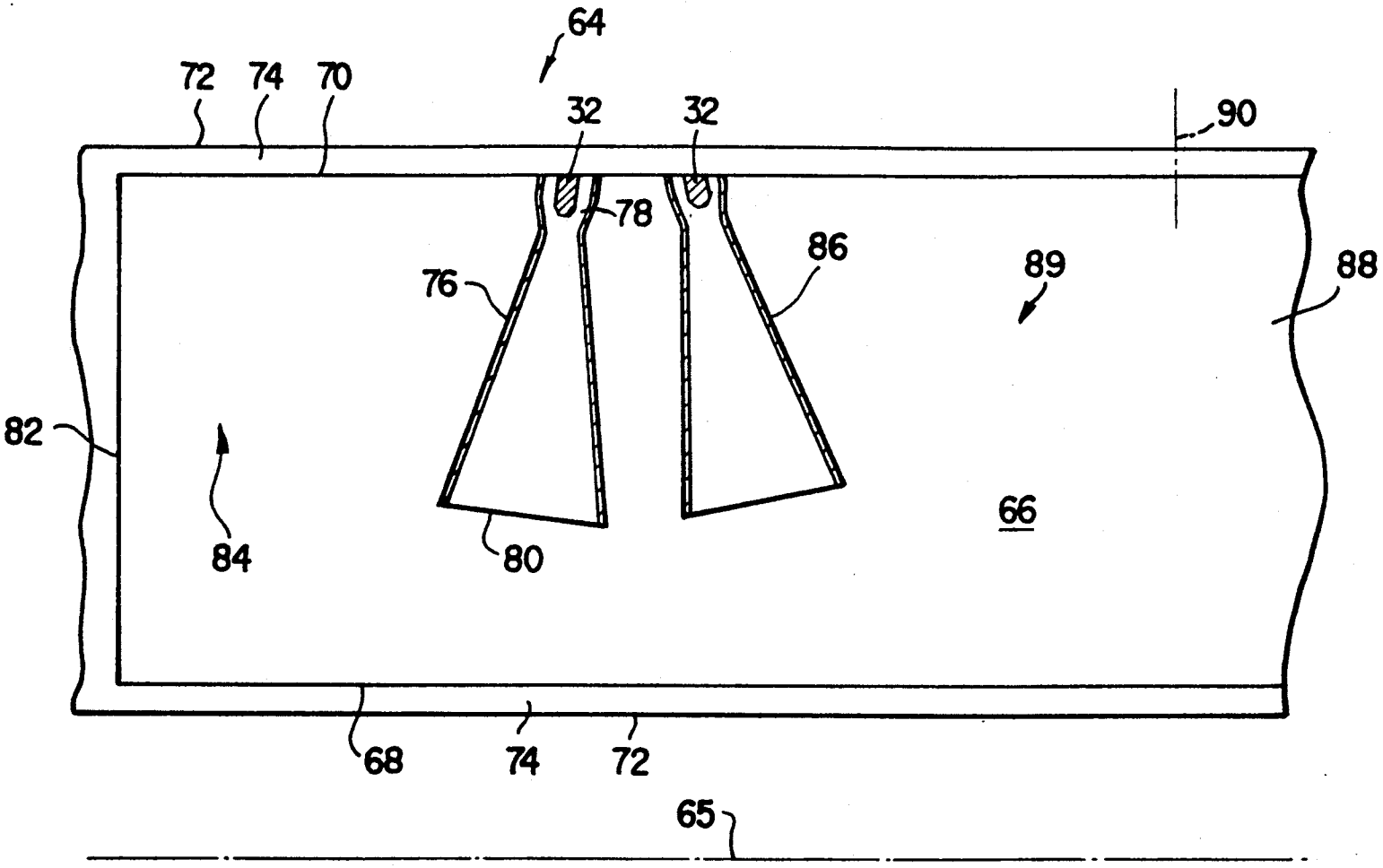
FIG. 4 is a cross-sectional principle view of an annular combustor incorporating the teachings of the present invention.

In a second embodiment of the present invention shown in principle view in FIG. 4, an annular combustor is generally referred to as 64. Combustor 64 is comprised of a combustion chamber 66 which is defined by inner and outer hot combustor walls 68 and 70, respectively. Combustor walls 68 and 70 are radially spaced from one another relative to the center line 65 of the combustor Running substantially parallel to and spaced from each inner and outer hot combustor wall 68 and 70 are respective cold combustor walls 72 which define cooling air flow passages 74 through which engine air is directed to provide convection cooling for the hot combustor walls.

The embodiment of the present invention illustrated in FIG. 4 includes mixing means similar to the mixing means previously described with reference to FIGS. 2 and 3 but having a placement adapted for the annular combustor geometry. Specifically, the mixing means of the annular combustor illustrated in FIG. 4 includes primary diverging mixing cones 76 for defining a space wherein the fuel and air is mixed. Primary mixing cones 76 are substantially identical in configuration to the cones 24 illustrated in FIGS. 2 and 3.

Figure 5:
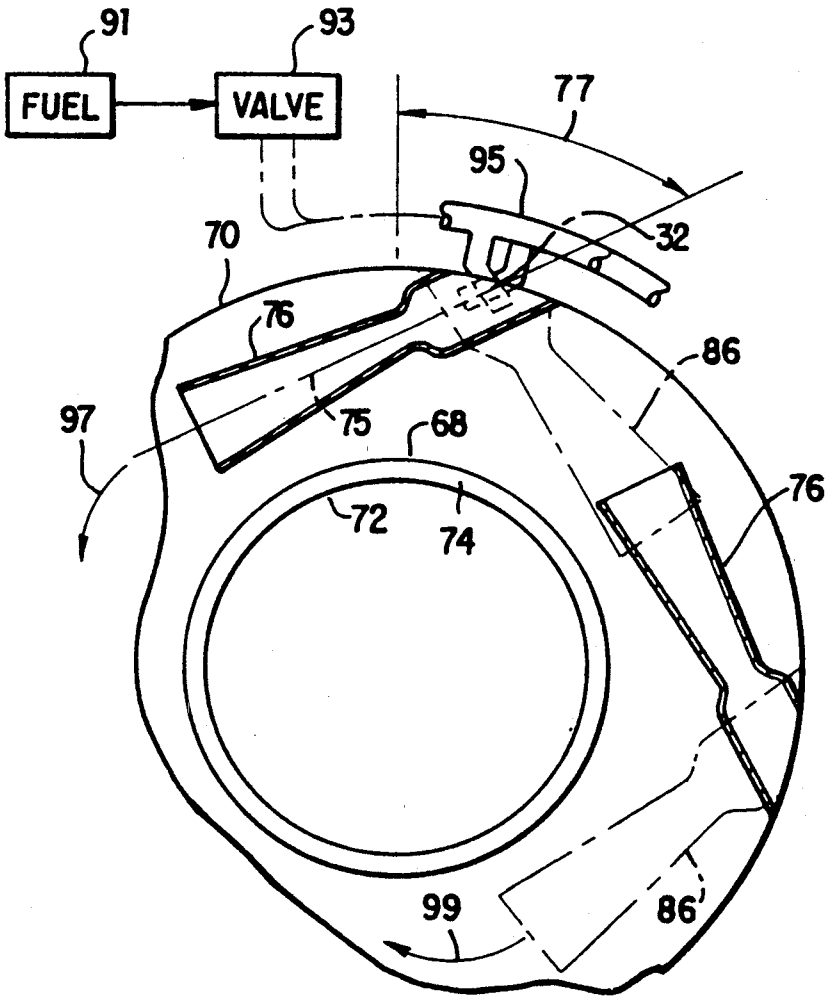
FIG. 5 is a partial end view of the annular combustor of FIG. 4.

With reference to FIG. 5 which shows a partial end view of combustor 64, primary cones 76 extend inwardly into combustion chamber 66 from outer hot combustor wall 70 and the central axis 75 of cones 76 is disposed at an angle 77 relative to a radius extending from center line 65 in a similar manner as illustrated for cones 24 shown in FIG. 3. Any desired number of primary cones sufficient to promote and enhance complete combustion within the combustion chamber 66 may be used.

Each primary cone 76 includes an inlet end 78 and an outlet end 80 with inlet end 78 being in flow communication with a source of fuel 91 via a valve arrangement 93, fuel manifolds 95, and ultimately a fuel injector 32 disposed at inlet end 78. Engine air is supplied to the inlet ends of primary cones 76 in substantially the same manner as previously described for cones 24. Furthermore, primary cone 76 is tilted toward an upstream end 82 of combustion chamber 66 so as to initially direct and deposit the fuel and air mixture emerging from cone 76 in a primary combustion zone 84 which is proximate upstream end 82 of the combustion chamber.

The fuel-to-air weight ratio of the mixture emerging from primary cones 76 is kept below the chemically correct stoichiometric ratio so as to reduce the flame temperature in primary combustion zone 84 thereby reducing $NO_x$ formation. Of course, the fuel-to-air weight ratio in primary cones 76 varies between the lean blowout lower limit and the preset upper limit as the power output of the engine is increased. In the preferred embodiment of the present invention, the upper limit of the fuel-to-Air weight ratio in primary cones 76 is set at about 50% of the stoichiometric value. However, a higher ratio may be selected within the scope of the invention so long as the corresponding flame temperature is kept low enough to reduce $NO_x$ formation in the primary combustion zone.

Also, since $NO_x$ is formed only during the high temperature, non-equilibrium condition immediately after ignition of the fuel in primary combustion zone 84, and residence time is not a factor significantly influencing $NO_x$ formation, the combustor of the present invention may be designed such that the combustion products have a residence time greater than has previously been thought permissible. With such an increased residence time capability unburned hydrocarbons and CO are significantly reduced thereby reducing overall pollutant emissions from the engine.

A further advantage of the configuration of the embodiment of the present invention illustrated in FIG. 4 is the ability to utilize fewer fuel injection nozzles than known annular combustor configurations. This advantage results from the enhanced vaporization occurring within the cone 76, and as a further result of the position of cones 76 relative to outer hot combustor walls 70. That is, since cones 76 are disposed substantially tangentially relative to outer hot combustor wall 70, the fuel and air mixture emerging from cone 76 is directed into an annular flow path around primary combustion zone 84 as shown by arrow 97 in FIG. 5. The directed flow in the peripheral direction about primary combustion zone 84 results in improved flame holding and reduces the number of injectors required. Obviously, reducing the number of injection nozzles eliminates potential problems with regard to clogging of smaller nozzles and subsequent discontinuities in the burn pattern within the combustion chamber and reduces cost of hardware.

In instances where the operating range of the engine requires additional fuel flow range over and above that provided through primary cones 76, annular combustor 64 may also be configured with secondary diverging mixing cones 86 which are tilted toward the downstream end 88 of combustion chamber 66 so as to direct the fuel and air mixture exiting from the secondary cones toward a secondary combustion zone 89 disposed proximate downstream end 88 of combustion chamber 66. Such secondary cones would be required where the operating range of the engine cannot be fully met with the fuel flow through primary cones 76. In those instances, additional fuel may be injected into secondary combustion zone 89 in the same manner as described above with reference to FIG. 7.

With reference to FIG. 5, secondary cones 86 extend from hot combustor wall 70 at an angle which is opposite to angle 77 but preferably of the same magnitude. In this manner, secondary cones 86 direct the secondary fuel and air mixture in a direction 99 around annular combustion chamber 66 which is opposite to the direction 97 in which the flow from primary cones 76 is directed. Thus, when the combustion products from the primary combustion zone enter the secondary combustion zone a counter swirl condition is created in the secondary zone to enhance mixing and oxidation/ combustion of the secondary fuel and air stream.

In the annular combustor 64, just as with the can-type combustor previously described, the means for defining primary and secondary combustion zones within the combustion chamber means comprises a flow restriction created by the walls of the cones 76 and 86. Furthermore, dilution holes 90 are configured in the inner and outer hot combustor walls so as to add dilution air from cooling air flow passage 74 into the combustion chamber upstream of secondary combustion zone 89. The dilution air acts to reduce the temperature of the products of combustion to a level which is acceptable for use in a turbine or other end device.

Figure 6:
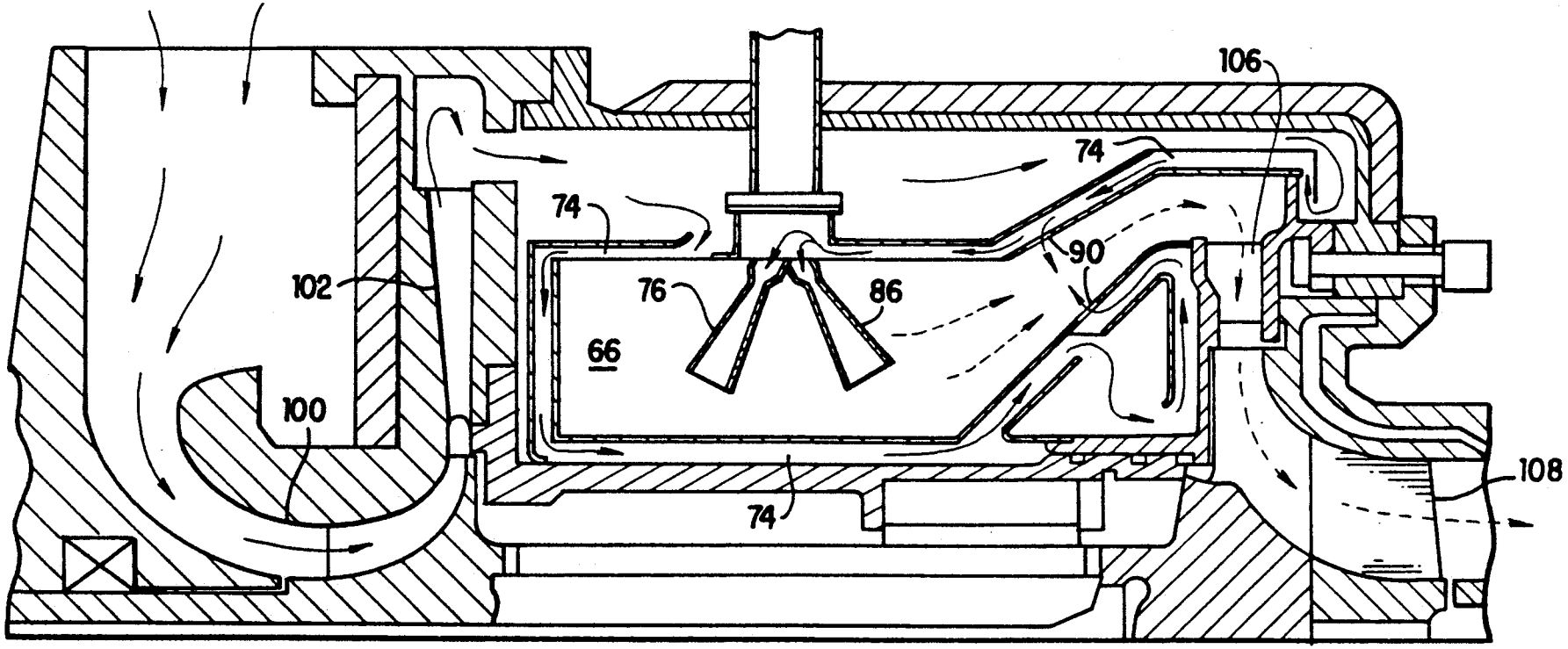
FIG. 6 is a cross-sectional view of the annular combustor of FIG. 4 installed in a radial gas turbine engine module.

FIG. 6 is a cross-sectional view of a radial turbine engine module having the annular combustor of the present invention disposed therein. In FIG. 5, a compressor 100 feeds engine air to a diffuser 102. From diffuser 102, the engine air enters cooling air flow passage 74, primary and secondary c 76 and 86, and dilution holes 90 as shown by the arrowed lines. Fuel and air enters the combustion chamber 66 through mixing cones 76 and 86 as previously described. The remaining engine air is injected through dilution holes 90 to reduce the temperature of the products of combustion prior to entering a turbine inlet nozzle 106 and expanding through a turbine 108 to provide useful work.

Figure 9:
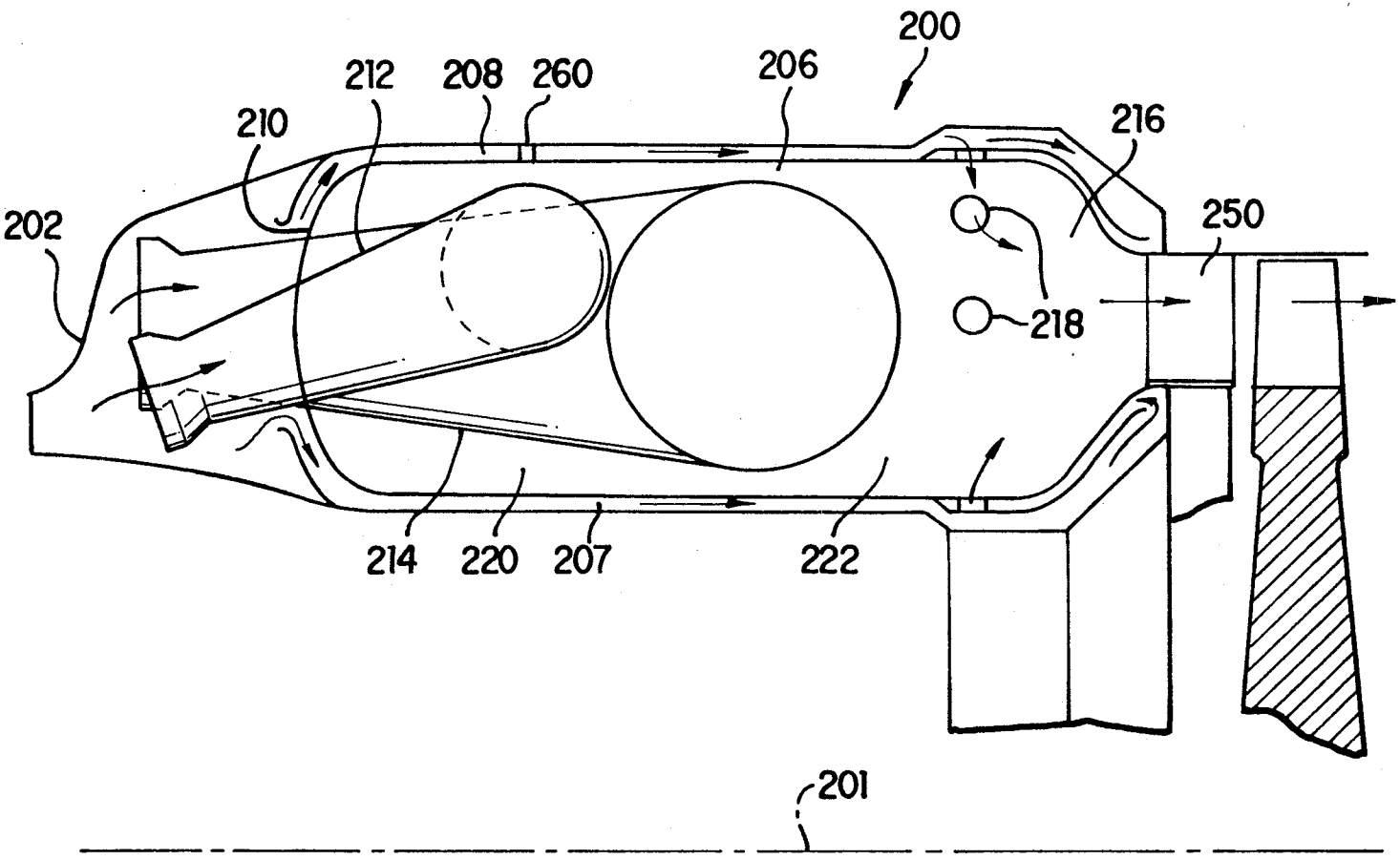
FIG. 9 is a partial side view of an annular combustor incorporating a further embodiment of the present invention.
Figure 10:
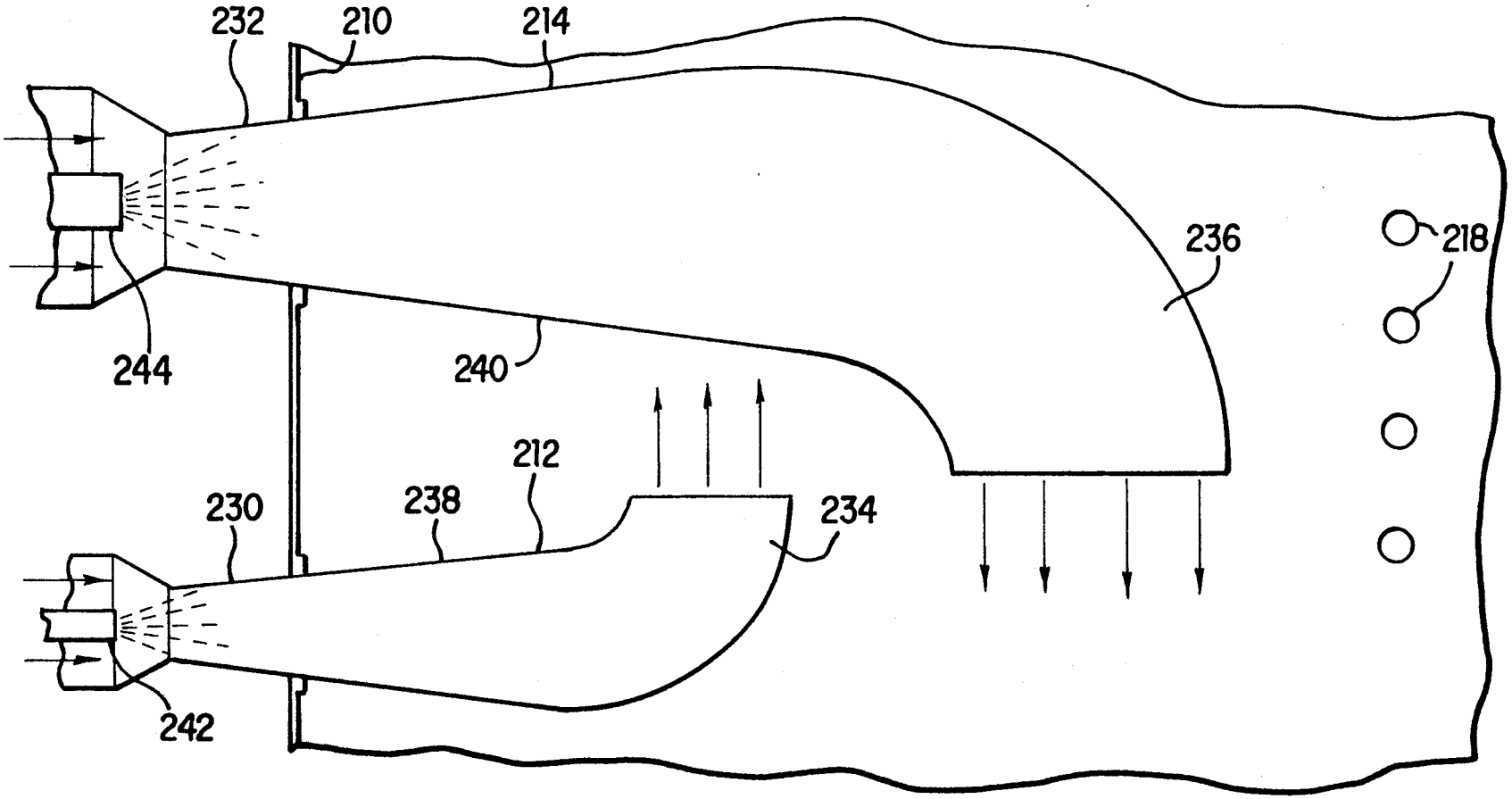
FIG. 10 is a detailed side view of the primary and secondary mixing cones shown in FIG. 9.

Another embodiment of the present invention, illustrated in FIGS. 9 and 10, is adapted to annular gas turbine combustors with insufficient radial height to incorporate the radially inwardly disposed mixing cones described above. This embodiment is also well adapted for engines of the "straight through flow" type which is typical for large, commercial jet engines. The embodiment of FIGS. 9 and 10 can also be used as a variant to the previously described configurations where particular geometric limitations mandate.

FIG. 9 illustrates in cross-section an annular combustor 200 which is radially spaced from and extends axially relative to engine center line 201. Engine air enters inlet 202 of combustor 200 from the turbine engine compressor and flows generally axially through combustor 200 to outlet end 204. Combustor 200 includes an inner hot chamber 206 surrounded by inner and outer annular cooling air passages 207 and 208. Extending into inner chamber 206 through an end wall 210 of inner chamber 206 is at least one primary diverging mixing cone 212 and at least one secondary diverging mixing cone 214. The primary and secondary mixing cones are disposed within inner chamber 206 and constitute a means of mixing fuel and air and for depositing the fuel and air mixture within the combustion chamber. In the annular combustor illustrated, it is probable that a plurality of primary and secondary mixing cones will be disposed about the diameter of the annulus. For purposes of illustration, only one of each is shown in FIGS. 9 and 10.

The engine air entering inlet 202 is distributed to primary mixing cones 212, secondary mixing cones 214. Also, a portion of the engine air enters inner and outer annular cooling passages 207 and 208 as shown by arrows in FIG. 9 and acts to cool the walls of inner combustion chamber 206 by means of convection. At least a portion of the cooling air which passes through annular passages 207 and 208 enters the downstream end 216 of inner chamber 206 through dilution holes 218 for purposes previously described with reference to the other embodiments of the present invention.

The mixing cones are disposed generally axially relative to center line 201 as best shown in FIG. 10. Both primary and secondary mixing cones may be aligned at an angle relative to both the axial and transverse axes of combustor 200. The inclined angle may be up to about approximately 45°. As with the previously described embodiments of the present invention, the mixing cones act to divide inner hot combustion chamber 206 into primary and secondary combustion zones 220 and 222 by creating a flow restriction therein.

The number of mixing cones in primary zone 220 and secondary zone 222 may be the same or different, depending on the space available. For instance, the number of primary cones 212 may be double of the number of secondary cones 214 in order to better utilize the space in the primary zone.

As best seen in FIG. 10, both the primary and secondary diverging mixing cones 212 and 214 have respective inlet ends 230, 32 and outlet ends 234, 236 connected by respective diverging, preferably conical, walls 238, 240. Outlet end 236 of secondary cone 214 is disposed further away from end wall 210 than is the outlet end 234 of primary cone 212 so as to direct the fuel and air mixtures exiting therefrom into the respective primary and secondary combustion zones. In the present embodiment, primary cone 212 and secondary cone 214 are configured with horn-shaped turns at outlet ends 234, 236 in order to direct the fuel and air flow exiting the mixing cone into the peripheral direction about inner chamber 206. Preferably, outlet ends of primary and secondary cones 212 and 214 are disposed to direct their respective flows in opposite peripheral directions about the combustion chamber, to improve mixing.

In the preferred embodiment the half angle of conical walls 238, 240 should be less than or equal to about 6°, but the invention is not limited thereto. Also, variations from the conical, i.e., circular, cross section of the mixing cones to elliptical or "race track" for all or part of the length of walls 238, 240 may be made as long as flow separation does not cause recirculation and combustion within the mixing cones.

The operation of the primary and secondary mixing cones by themselves and in relationship to each other is the same as discussed above with respect to other embodiments of the invention, with the distinction being that the mixing cones are displaced from the generally radial direction to the generally axial direction and the air and fuel flow emerging from the mixing cones is redirected through the curved outlet ends 234, 236.

Fuel nozzles 242 and 244 are placed near inlet ends 230, 232 of primary and secondary mixing cones 212 and 214. In adapting this embodiment of the invention to an annular combustor configuration, the primary and secondary mixing cones are displaced around the annulus in a nominally even way. After combustion has taken place in the secondary zone 222, dilution air is added at 218 whereupon total mass flow enters the nozzle guide vanes 250 of the high pressure turbine.

Spacers 260 may be used to maintain the spacing of the annular walls defining cooling passages 207 and 208.

The configuration shown in FIGS. 9 and 10, although particularly suitable for annular combustors, can also be used for combustors with a can-type configuration. Furthermore, some applications may only require one set of mixing cones to achieve the purposes of the invention.

Figure 11:
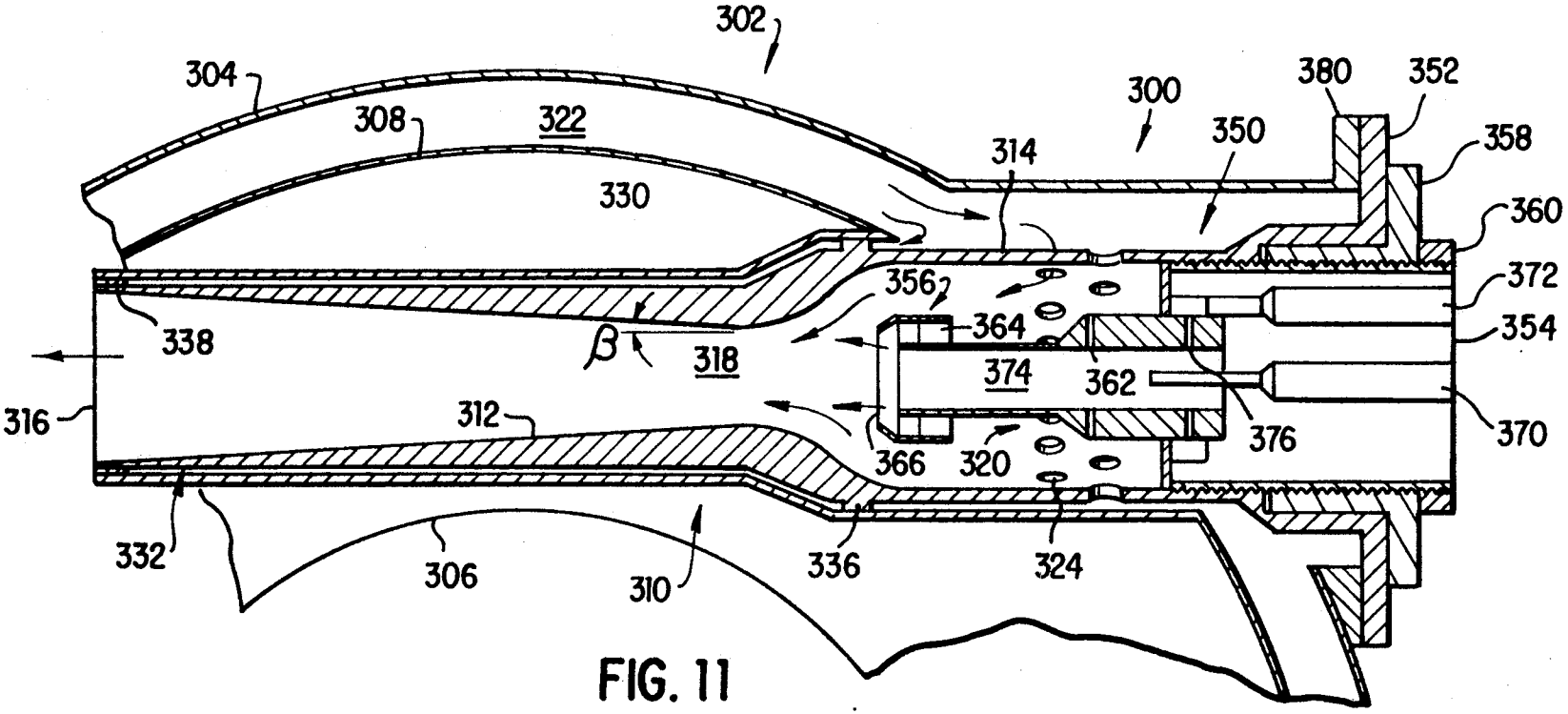
FIG. 11 is a partial schematic side view of an annular combustor incorporating a further embodiment of the present invention.
Figure 12:
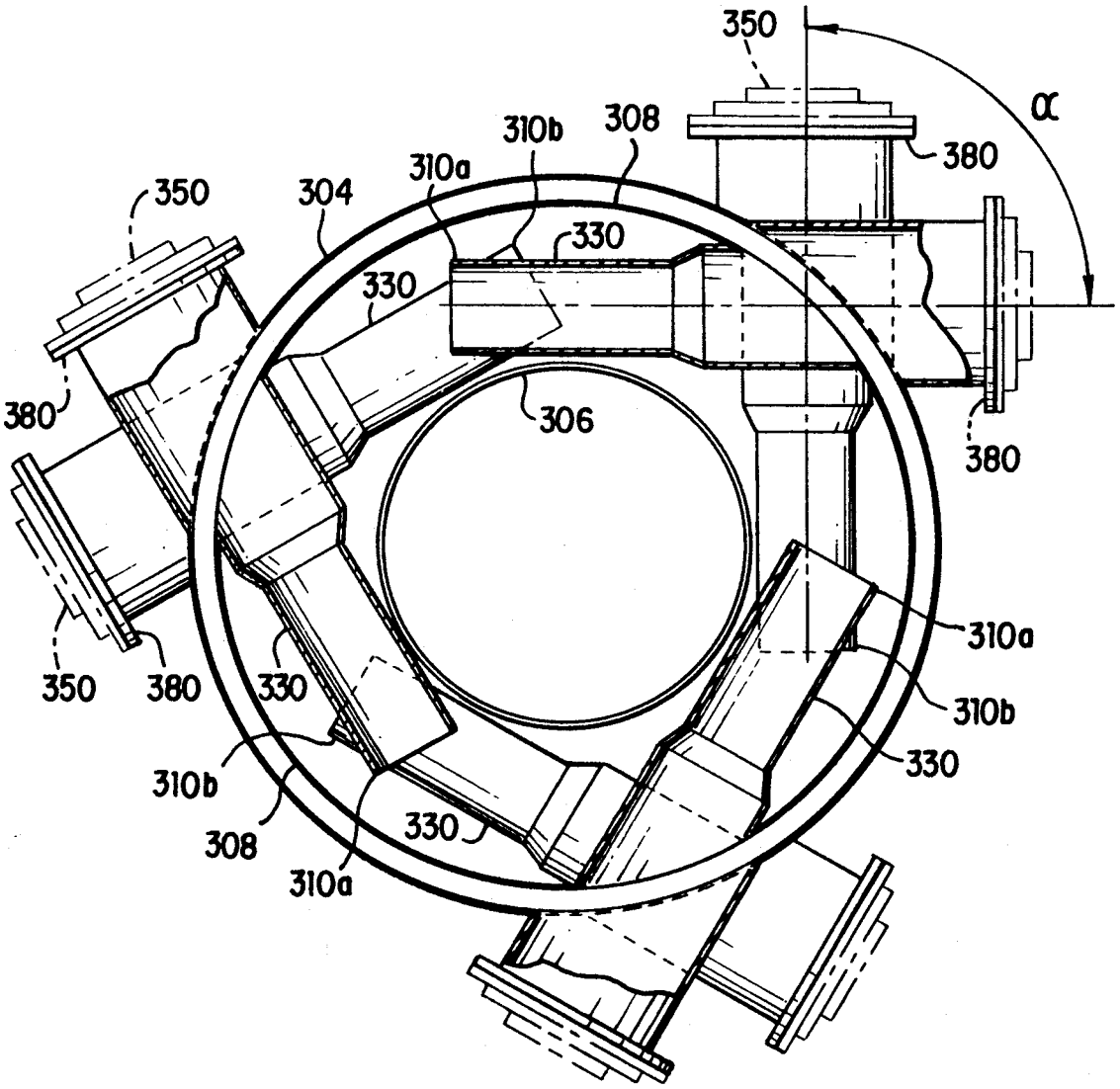
FIG. 12 is a schematic end view of the embodiment shown in FIG. 11.

FIGS. 11 through 12 disclose a further preferred embodiment of the present invention, which embodiment is designated generally by the numeral 300. With initial attention to FIG. 11, the combustor includes an annular combustion chamber 302 having an outer wall 304, inner wall 306, and a combustor liner 308. The combustor 300 further includes a plurality (only one being shown in FIG. 11) of primary and secondary mixing cones such as cone 310. Mixing cone 310 includes an elongated body portion 312 having a diverging conically shaped interior cavity with an entrance end 314 for receiving the fuel air mixture and an exit end 316 for delivering the well-mixed fuel air mixture at an appropriate location and direction in combustion chamber 302. The interior cavity defined by the inner wall of mixing cone body 312 is in the general shape of venturi having a throat 318 of minimum flow area positioned adjacent the mixing cone inlet 314. As in shown in FIG. 11, the conically diverging interior wall of mixing cone body 312 includes a divergence half angle designated beta ($\beta$) which should be $\leqq 6°$. Mixing cone 310 is feed from fuel nozzle means designated generally 320 which will be described in more detail hereinafter and receives combustion air from the space 322 between outer wall 304 and lines 308 through apertures, 324 located in mixing cone body 312 at the entrance end 314 thereof.

Figure 11B:
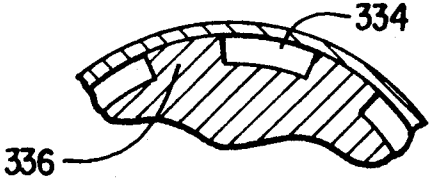
FIG. 11*b* is a detail of the embodiment shown in FIG. 11.

The function and operation of the combustor 300 including mixing cone 310 is substantially the same as that of the previously discussed embodiments but has the following additional features and advantages. Specifically, it has been determined that it is essential to avoid combustion inside the divergent mixing cones. Such combustion can occur through auto-ignition of the combustible charge inside the mixing cone caused by heat transfer from the combustion external to the cone through the cone wall. In accordance with the present invention, therefore, the combustor further includes means cooperating with the mixing means for suppressing such auto-ignition of the fuel air mixture in the primary and secondary mixing cones. As embodied herein and with continued reference to FIG. 11, combustor 300 further includes shroud member 330 surrounding and spaced from mixing cone body 312 to define a concentric flow passage 332 therebetween. A small amount of combustion air is metered from space 322 through flow passage 332 by control passage spaces 334 (see detail in FIG. 11*b*).

Test experience has shown that the divergence half angle $\beta$ in FIG. 11 should be limited to less than or equal to approximately 6° in order to avoid excessive build up of a boundary layer along the inner wall of mixing cone body 312. Because combustion could take place in the boundary layer, minimizing the build-up of the boundary layer also will help to achieve suppression of auto-ignition in mixing cone 310.

Still further in accordance with the present invention, each mixing cone and associated fuel nozzle means are configured as a integrated unit assembly retractable from the combustion chamber. The purpose of such configuration is to allow the fuel/air ratio to be carefully calibrated and set prior to installation of the assembly including the mixing cone into the combustion chamber. Careful calibration of the fuel/air ratio is essential to the reduction of $NO_x$ and can be more easily and accurately carried out if the fuel nozzle and mixing means are separated from the rest of the combustor and mounted on previous test apparatus, as one skilled in the art would readily appreciate.

As embodied herein, and with continued reference to FIG. 11, the integrated, retractable unit assembly designated generally by the numeral 350 includes mixing cone body 312, control passage spacer element 336, clearance guides 338, and a mixing cone flange portion 352. The integrated, unit assembly 350 further includes fuel nozzle means 320 including fuel nozzle subassembly 354 having a main nozzle 356, adjustment flange 358 interconnected threadedly to fuel nozzle sub-assembly 354 and lock nut 360.

Figure 11A:
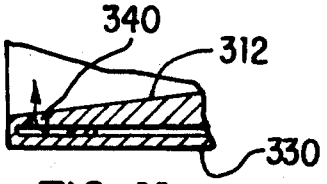
FIG. 11*a* is a detail of an alternative constructions to a part of the embodiment depicted in FIG. 11.

Still referring to FIG. 11, the combustion air enters annular space 322 between the outer wall 304 and the combustion liner 308 from a source such as a compressor (not shown). The combustion air then enters mixing cone body 312 through apertures 324 in the mixing cone entrance portion 314. These openings have a total area which is substantially larger than the area of throat 318 of mixing cone 310. Some of the combustion air enters the annular space 332 to cool mixing cone 312, in an amount determined by the control passage spacer 336. The amount of cooling air will be set according to the intended operating conditions of the combustor, but will be kept as low as possible in order to extend the lean limit of the combustion process, and hence obtain the lowest possible $NO_x$ level. The cooling air may either join the pre-mixed fuel air charge at the exit 316 of mixing cone 310 as shown in FIG. 11 or, as shown alternatively in FIG. 11*a*, be channeled throUgh orifices 340 and mixed into the fuel air mixture prior to exiting mixing cone 310. As would be understood by one skilled in the art, control passage spacer 336 in addition to metering the cooling air flow through passage 332 also acts as a clearance guide in the same way as guide 338. Guide 338 in the disclosed embodiment has only the function of controlling the annular space of cooling passage 332, and can be conveniently made an integral part of mixing cone body 312. Of course, one skilled in the art would realize that the flow metering could be accomplished by guides 338 and that the control passage spacer 336 could merely act as a spacer element, or both could have metering functions. These variations are considered to come within the scope of the present invention as defined by the appended claims.

After the combustion air has entered openings 324, it passes through the mixing cone throat area 318 for mixing with the fuel supplied by the fuel nozzle means 320. The fuel nozzle subassembly 354 of fuel nozzle means 320 shown in the drawing is a combined liquid fuel and gas fuel nozzle of the "air blast" type, in which part of the fuel/air atomizing and mixing takes place within the nozzle sub-assembly itself. This is accomplished by admitting combustion air into the nozzle sub-assembly through orifices 362 located upstream of the exit 366 of nozzle 356. The partially pre-mixed air and fuel combine with the rest of the combustion air entering the mixing cone 310 at throat 318 to form the main portion of the pre-mixed fuel/air charge. The final part of the fuel/air charge is formed by the introduction of the cooling air from channel 332 at the end of mixing cone 310, as discussed previously.

Fuel nozzle means 320 is shown with a central, liquid fuel entry connection 370 and a gas fuel entry connection 372. All fuel entries into the central cavity 374 of fuel nozzle 356 except the liquid fuel from central fuel line 370 are purposely made to have a tangential velocity component such that the entries are made to "swirl" in a common direction. The entries such as combustion air through 362 and gaseous fuel through orifice 376 are shown as radial in the drawing only for ease of illustration. Other fuel nozzle configurations may be used as long as they are mechanically connected to mixing cone body 312 to insure stable positioning of throat 318 relative to nozzle 356 in order to provide a constant fuel/air relationship independent of movements due to distortions and other effects that could otherwise cause changes in the fuel/air ratio.

It is very important to insure that the fuel/air ratio is kept equal and constant for all the mixing means utilized in the combustor. In the present embodiment, this is accomplished during calibration by moving the fuel nozzle sub-assembly 354 by using a threaded engagement between sub-assembly 354 and adjustment flange 358. Relative axial movement between fuel nozzle sub-assembly 354 and adjustment flange 358 causes the gap between nozzle 356 and mixing cone throat 318 to vary, because the positions of adjustment flange 358 and mixing cone flange 352 are kept constant.

As stated earlier, the calibration and adjustment can conveniently be made with unit assembly 350 removed from the combustion chamber and mounted for instance in a jig where the air flow through the unit can be measured, for example over a bellmouth, with appropriate pressure and temperature sensors in a manner generally known to anyone skilled in the art. After all unit assemblies of combustor 300 have been adjusted and calibrated, they would be instaled in combustor 300 by inserting the mixing cone body 312 into the respective shroud 330 which is fixedly attached to and remains with combustion chamber liner 308. Mixing cone flange 352 would be bolted up to attachment flange 380 provided in the outer wall 304 of combustion chamber 302. Finally, the fuel line or fuel lines in the case of a dual fuel nozzle, would be connected.

With reference now to FIG. 12, a schematic end view of an arrangement is shown in which shrouds 330 for 3 primary and 3 secondary mixing cones are shown permanently fastened (welded) to combustor chamber liner 308. Also, shown are attachment flanges 380 welded or otherwise fixed to outer wall 304. Depicted schematically and shown in dotted lines in FIG. 12 are the inserted integrated, unit assemblies 350. Of course, the number of mixing cones, the angl alpha ($\alpha$and the angle between the cone axis and the combustor axis (into the paper-not depicted) will vary according to the application. Primary mixing cones 310*a* and secondary mixing cones 310*b* shall, however, have opposite angular directions of entry as indicated in FIG. 12. As one of ordinary skill in the art would also understand, the specific features and advantages shown in the present embodiment could be applied to the previously discussed embodiments in order to achieve the stated advantages.

Figure 13:
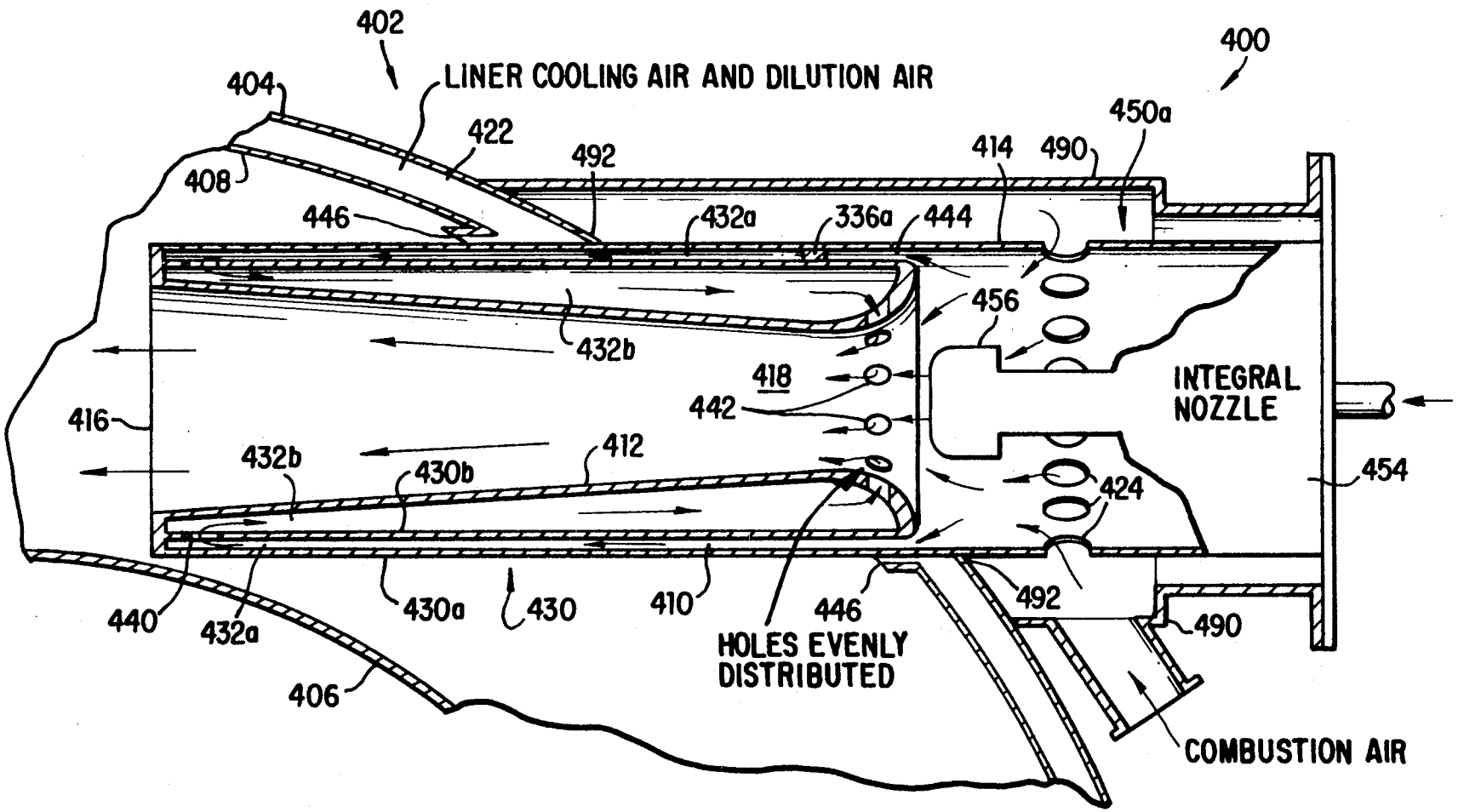
FIG. 13 is a partial schematic side view of yet another embodiment of the present invention.

FIG. 13 depicts an alternative embodiment of the combustor shown in FIG. 11 but still retaining the auto-ignition suppression and the integrated, unit assembly concepts utilized in the FIG. 11 embodiment. In the FIG. 13 embodiment, the combustor made in accordance with the present invention and designated generally by the numeral 400, includes combustion chamber 402 having outer wall 404, inner wall 406, and a combustion liner 408 defining space 422 for cooling air and dilution air. One of a plurality of mixing cones designated generally 410 includes mixing cone body 412 in the shape of a venturi having inlet end 414, exit end 416, and throat portion 418. Fuel nozzle subassembly 454, including fuel nozzle 456 is used to supply fuel to mixing cone 410 in much the same fashion as the corresponding components in the FIG. 11 embodiment. Air for mixing with the fuel from nozzle 456 is admitted through apertures 424, is thoroughly mixed by the converging-diverging action provided by throat 418 and the diverging conical downstream section, and the resultant fuel-/air mixture exits mixing cone 410 at exit 416.

While the embodiment shown in FIG. 13 also includes means for suppressing auto-ignition, the means employed in the FIG. 13 embodiment differ in construction from the means used in the FIG. 11 embodiment. Specifically, and as embodied herein, combustor 400 includes double-walled shroud assembly 430 comprising concentric outer and inner walls 430*a* and 430*b*. The depicted construction forms cooling flow passages 432a in which the cooling air flow is in the same general direction as the fuel/air mixture in mixing cone 410, and also counter-current cooling flow passag 432*b* in which the cooling flow is opposite in direction to the fuel/air mixture in mixing cone 410. Cooling flow passages 432*a* and 432*b* are interconnected adjacent mixing cone exit end 416 via slots or apertures 440. Still further, apertures 442 are provided in the wall of mixing cone body 412 adjacent to, but immediately upstream of, throat 418 interconnecting cooling flow passage 432*b* and the interior of mixing cone 410.

In operation, a small amount of cooling air taken from the combustion air at mixing cone inlet end 414 is admitted to passage 432*a* at location 444, flows along passage 432*a*, and enters cooling flow passage 432*b* through apertures or slots 440. The cooling air flow then travels in passage 432*b* until it exits that cooling passage and enters the interior of mixing cone 410 through apertures 442, whereupon it is thoroughly mixed with the fuel/air mixture in the mixing cone. Spacers/control passage elements 336*a* (a total of 3 preferred), act to space apart walls 430*a* and 430*b*, and also to meter the cooling air flow, if required. Because of the locations of cooling air flow inlet 444 and apertures 442 interconnecting with the interior of mixing cone 410, a positive pressure differential acts to drive the cooling air flow. Hence the temperature of the wall of mixing cone body 412 can be adequately cooled to prevent auto-ignition while the cooling air can be combined with the fuel/air mixture upstream of the mixing cone exit 416 to enhance the homogeneity of the mixture, and hence tend to make further reductions in $NO_x$ possible. Openings 442 are located closely adjacent to throat 418, in order to provide a sufficient pressure differential to drive the cooling air through the channels, and yet far enough from the actual location of throat 418 in order not to disturb the flow through the throat. One skilled in the art would be able to determine the precise locations for apertures 442 for a particular configuration and application.

In the embodiment shown in FIG. 13, shroud assembly 430 is made an integral part of the unit assembly 450*a* also comprising mixing cone 410 and fuel nozzle subassembly 454. Integral, unit assembly 450*a*, as with unit assembly 350 in FIG. 11, is removable from combustor 400 to allow calibration and setting of the fuel-/air mixture with precision. Seating collar 446 is provided on combustor liner 408 to closely receive outer wall 430*a* of shroud assembly 430 when unit assembly 450*a* is installed in combustor 400. Appropriate seals (not shown), sliding fits or other devices are provided to prevent unacceptable amounts of air leaking between collars 446 and shroud wall 430*a*. Construction of such seals and sliding fits would be well within the skill of one working in this art.

Still further in accordance with the present invention, means are provided to controllably distribute the air for mixing with the fuel to at least some of the primary and secondary mixing cones of the combustor. As embodied herein, and as shown in the FIG. 13 embodiment, manifold 490 is configured to surround the inlet end 414 of mixing cone 410 in order to supply combustion air to the mixing cone through apertures 424. Manifold 490 can interconnect primary and secondary mixing cones or all or a lesser number of primary mixing cones only, with a separate manifold being used to connect all or a lesser number of the secondary mixing cones.

In the embodiments discussed previously, no separate supply of combustion air to the mixing cones has been utilized. The assumption was made that the air was taken from the gap between the outer combustion chamber wall and the combustion liner, e.g. the space corresponding to space 322 in the FIG. 11 embodiment. Because the space between the combustion liner and the outer combustion chamber wall can vary during operation, the amount of air passing through each mixing cone could vary, with the result that the fuel/air ratio would vary and emissions control be impaired.

In the FIG. 13 embodiment, however, a separate supply of combustion air is provided by utilizing manifold 490, either directly from the compressor (not shown) and/or by passing the cooling air from space 422 into manifold 490 after the convection cooling requirement has been satisfied. The latter arrangement also would have the additional advantage of providing a more even cooling to the combustion liner, such as combustion liner 408 in the FIG. 13 embodiment, especially in those situations using a limited number of mixing cones. Openings or holes interconnecting space 422 and the interior of manifold 490, such as holes 492 shown in the drawing, can be tailored depending on local cooling requirements to provide a path for the convection cooling air into manifold 490, as will be understood by one skilled in the art.

The present invention also encompasses a method for operating a gas turbine engine combustor of the type having sequentially aligned primary and secondary combustion zones separated and defined by at least one primary mixing cone disposed within the combustion chamber to create a flow restriction therein. The steps of the method of the present invention are illustrated in the block diagram of FIG. 8. At step 150, primary fuel and primary air are mixed in the primary mixing cone at a fuel-to-air ratio less than the stoichiometric ratio of the fuel employed. At step 152 the primary fuel and air mixture is deposited into the primary combustion zone where it is ignited. Preferably, the fuel-to-air weight ratio in the mixing cone is carefully controlled and limited to less than about 50% of the stoichiometric ratio of the fuel employed. In this manner, when the primary fuel and air mixture is burned in the primary combustion zone the flame temperature is reduced thereby reducing formation of $NO_x$ in the primary zone.

Figure 8:
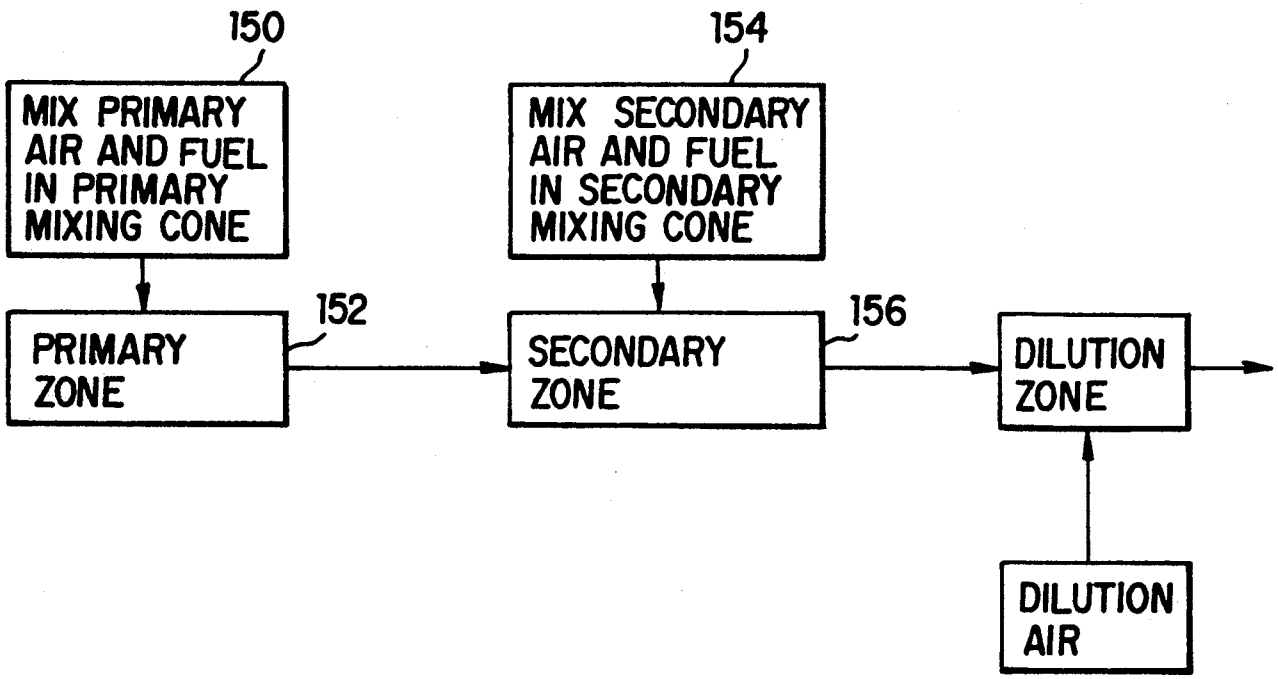
FIG. 8 is a block diagram illustrating the steps of the method of the present invention.

In instances where the operating range of the engine employing the combustor of the present invention requires additional fuel flow beyond that in the primary mixture, the method of the present invention encompasses the additional step of mixing secondary fuel and secondary air in a secondary mixing cone disposed in the combustion chamber as shown in block 154 of FIG. 8. Thereafter, the secondary fuel and air mixture from the second mixing cone is deposited in the secondary combustion zone at block 156 where it is oxidized/-burned by mixing with the hot products of combustion emerging from the primary combustion zone. As the engine power requirements increase, the fuel-to-air weight ratio in the secondary mixing cones may be increased as illustrated on the graph of FIG. 7.

Also, the method of the present invention encompasses the step of adding dilution air into the combustion chamber in a dilution zone disposed downstream from the secondary combustion zone. As previously described, the dilution air acts to lower the temperature of the hot products of combustion such that air suitable for use in an end device connected to the gas turbine engine.

Finally, it should be noted that these mixing cone untis can function both as "primary" and "secondary" mixers when installed in the combustion-chamber, i.e. under certain conditions, what is normally term "secondary" mixers may be the first ones to be activated under, for example, starting conditions thus making maximum use of the flexiblity that a two stage system can offer in order to achieve the best overall engine performance, including reduced omissions.

By practicing the steps of the method of the present invention, the flame temperature within the primary combustion zone may be reduced to thereby reduce the formation of $NO_x$. Furthermore, as illustration in FIG. 7, since the fuel-to-air weight ratio in the secondary fuel and air mixture is also maintained below the stoichiometric fuel-to-air ratio $NO_x$ formation is also singificantly reduced when the fuel is combusted in the secondary combustion zone. Moreover, since $NO_x$ formation is essentially independent of residence time within a combustor, the method fht epresent invention may also include maintaining the residence time of the fuel and air in a combustion chamber for a period of time sufficient to substantially reduce the amount of hydrocarbon and carbon monoxide. Thus, the method and apparatus of the present invention provide a combustor for a gas turbine engine wherein $NO_x$ and unburned hydrocarbons and CO emissions are substantially reduced over prior art combustor configurations.

Additional advantages and modifications will readily occur to those skilled in the art. For instance, the flow restriction which separates the primary and secondary combustion zones may be comprised of a narrowing of the hot combustor walls at the position where the flow restriction is to be placed. Alternatively, a combination of narrowed hot combustor walls and diverging cones may be used to provide the flow restriction. Also, more than two combustion zones may be defined within the combustion chamber to further stage the burn of the fuel, and thereby further reduce emissions. Therefore, the invention in its broader aspects is not limited to the specific details, representative devices, and illustrative examples shown and described. Accordingly, departures may be made from such details without departing from the spirit or scope of the general inventive concept as defined by the appended claims and their equivalents.

What is claimed is:

1. A pre-mixed, convection cooled, low emission combustor, comprising:

a combustion chamber for defining a space within which fuel and air are combusted, said chamber having an upstream inlet end and a downstream outlet end axially aligned relative to one another;

means, disposed within said combustion chamber, for mixing fuel and air and for depositing a fuel and air mixture into said combustion chamber;

said mixing means including at least one primary diverging mixing cone and at least one secondary diverging mixing cone each having an inlet end for receiving compressed air and fuel to be mixed within the cone, each of said mixing cones being disposed to extend substantially axially relative to said combustion chamber with the inlet ends thereof disposed proximate the inlet end of said combustion chamber;

said primary mixing cone having an outlet end disposed at a first distance from said combustion chamber inlet end and said secondary mixing cone having an outlet end disposed at a second distance greater than said first distance, from said combustion chamber inlet; and said outlet ends of said primary and secondary mixing cones being configured to direct the air and fuel mixture emerging therefrom in a substantially circumferential direction about said combustion chamber.

2. The combustor of claim 1, wherein said outlet end of said first mixing cone is configured to direct the fuel and air mixture emerging therefrom is a first circumferential direction in said combustion chamber, and said outlet end of said second mixing cone is configured to direct the fuel and air mixture emerging therefrom in a second circumferential direction, opposite said first circumferential direction.

3. The combustor of claim 1, wherein said outlet ends of each of said mixing cones is curved relative to its respective inlet end so as to change the direction of flow of the fuel and air mixture emerging therefrom.

4. The combustor of claim 1, wherein said combustion chamber is substantially annular in configuration and said first and second mixing cones are disposed in a nominally even manner about the circumference of the annular chamber.

5. The combustor of claim 1, wherein said combustion chamber is can-shaped.

6. The combustor of claim 1, wherein said primary and secondary mixing cones include a substantially conical interior wall surface having a half angle of about 6° or less.

7. The combustor of claim 1, wherein said primary and secondary mixing cones include an interior wall surface having a substantially elliptical cross section.

8. The combustor of claim 1, wherein said combustion chamber includes a central axis between the inlet end and outlet end, and at least selected ones of said diverging mixing cones extend into said combustion chamber at a predetermined angle between about 0° and 45° relative to said central axis.

9. The combustor of claim 1, wherein said combustion chamber is annular in configuration.

10. The combustor as in claim 1 further including means cooperating with said mixing means, for suppressing auto-ignition of the fuel/air mixture in said primary and secondary mixing cones.

11. The combustor as in claim 10 wherein said suppression means includes respective shrouds surrounding and spaced from said primary and secondary mixing cones defining a channel for cooling air flow therebetween.

12. The combustor as in claim 11 further including means for metering said channel cooling air flow.

13. The combustor as in claim 11 wherein said shroud comprises a double-walled member configured to recirculate the cooling air to the vicinity of the inlet end of the respective mixing cone, and wherein said mixing cone includes means adjacent said mixing cone inlet end for flow interconnecting said cooling air flow channel and the interior of said mixing cone, whereby said cooling air flow is well mixed with the fuel and air mixture emerging from said mixing cone.

14. The combustor as in claim 13 wherein said mixing cone is venturi-shaped having a throat proximate said inlet end, and said flow interconnecting means are apertures in the wall of said mixing cone forming said throat.

15. The combustor as in claim 1 further including respective fuel nozzle means associated with said at least one primary and at least one secondary mixing cones, said mixing cones and associated fuel nozzle means being configured as an integrated unit assembly retractable from said combustion chamber, whereby the fuel/air ratio of each unit assembly can be calibrated and set prior to disposing said mixing cone in said combustion chamber.

16. The combustor as in claim 13 wherein said fuel nozzle means includes a nozzle and said primary and secondary mixing cones include venturis having throat portions through which the fuel/air mixture passes, said unit assembly including means for selectively adjustable fixing the distance between said venturi throat and said nozzle of said associated fuel nozzle means.

17. The combustor as in claim 15 wherein shroud means are provided to surround said primary and secondary mixing cones for suppressing auto-ignition, and wherein said shroud means are removable with said integrated unit assembly.

18. The combustor as in claim 1 further including manifold means interconnecting the respective inlet ends of at least several of said primary and secondary mixing cones for controllably distributing air for mixing with fuel.

19. The combustor as in claim 18 wherein said combustion chamber is convectively cooled and wherein means are provided for admitting at least a portion of air used for such convection cooling to said manifold.

* * * * *